US009863357B2

(12) United States Patent
Bouaita

(10) Patent No.: US 9,863,357 B2
(45) Date of Patent: Jan. 9, 2018

(54) FUEL INJECTION CONTROL IN AN INTERNAL COMBUSTION ENGINE

(71) Applicant: DELPHI AUTOMOTIVE SYSTEMS LUXEMBOURG SA, Bascharage (LU)

(72) Inventor: Abdelhamid Bouaita, Faneck (FR)

(73) Assignee: DELPHI AUTOMOTIVE SYSTEMS LUXEMBOURG SA, Luxembourg (LU)

( * ) Notice: Subject to any disclaimer, the term of this patent is extended or adjusted under 35 U.S.C. 154(b) by 584 days.

(21) Appl. No.: 13/940,651

(22) Filed: Jul. 12, 2013

(65) Prior Publication Data

US 2014/0014072 A1 Jan. 16, 2014

(30) Foreign Application Priority Data

Jul. 13, 2012 (EP) ..... 12176387

(51) Int. Cl.

| | |
|---|---|
| ***F02M 51/00*** | (2006.01) |
| ***F02D 41/30*** | (2006.01) |
| ***F02D 41/24*** | (2006.01) |
| *F02D 41/40* | (2006.01) |
| *F02D 41/20* | (2006.01) |

(52) U.S. Cl.

CPC ..... *F02D 41/3005* (2013.01); *F02D 41/247* (2013.01); *F02D 41/248* (2013.01); *F02D 41/402* (2013.01); *F02D 2041/2027* (2013.01); *F02D 2041/2055* (2013.01)

(58) Field of Classification Search

USPC ..... 123/472, 476, 478, 480, 490, 486, 499, 123/674; 703/103–105, 114; 361/152, 361/187; 239/533.4, 585.1; 701/102, 701/104

See application file for complete search history.

(56) References Cited

U.S. PATENT DOCUMENTS

| | | | | |
|---|---|---|---|---|
| 5,070,836 | A | 12/1991 | Wahl et al. | |
| 7,136,743 | B2 | 11/2006 | Peltier | |
| 8,571,821 | B2 | 10/2013 | Serra et al. | |
| 2002/0130192 | A1 | 9/2002 | McCoy et al. | |
| 2003/0130784 | A1* | 7/2003 | Peltier | F02B 61/045 701/104 |
| 2005/0121000 | A1 | 6/2005 | Vermonet et al. | |

(Continued)

FOREIGN PATENT DOCUMENTS

| | | | |
|---|---|---|---|
| EP | 1350941 | A1 | 10/2003 |
| EP | 1388661 | A2 | 2/2004 |

(Continued)

*Primary Examiner* — Carlos A Rivera
*Assistant Examiner* — Ruben Picon-Feliciano
(74) *Attorney, Agent, or Firm* — Joshua M. Haines

(57) ABSTRACT

A method of controlling fuel injection in an internal combustion engine is presented. For each injector event a drive signal is applied to the fuel injector, wherein said drive signal has a pulse width, which is calculated on the basis of a master performance function and of a minimum delivery pulse corresponding to the minimum pulse width required for the injector to open.

The minimum delivery pulse is determined from the voltage across the terminals of the fuel injector's electromagnetic actuator, by comparing the duration of a segment of the voltage second derivative to a predetermined threshold value.

7 Claims, 3 Drawing Sheets

(56) References Cited

U.S. PATENT DOCUMENTS

| | | | | |
|---|---|---|---|---|
| 2009/0139490 | A1* | 6/2009 | Stewart, Jr. | F02D 41/20 123/472 |
| 2011/0180046 | A1* | 7/2011 | Lehr | F02D 41/2096 123/488 |
| 2011/0278369 | A1 | 11/2011 | Serra et al. | |
| 2012/0116702 | A1* | 5/2012 | Beer | F02D 41/20 702/65 |
| 2013/0046454 | A1* | 2/2013 | Cowgill | F02D 19/024 701/104 |
| 2014/0000564 | A1* | 1/2014 | Shibata | F02D 41/401 123/472 |

FOREIGN PATENT DOCUMENTS

| | | | |
|---|---|---|---|
| EP | 2375036 | A1 | 10/2011 |
| EP | 2375037 | A1 | 10/2011 |
| EP | 2469064 | A1 | 6/2012 |
| EP | 2650518 | A1 | 10/2013 |
| FR | 2848253 | A1 | 6/2004 |
| FR | 2917462 | A1 | 12/2008 |
| WO | 2011073147 | A1 | 6/2011 |

* cited by examiner

FUEL INJECTION CONTROL IN AN INTERNAL COMBUSTION ENGINE

FIELD OF THE INVENTION

The present invention generally relates to internal combustion engines and more generally to injection control in such engines.

BACKGROUND OF THE INVENTION

The contemporary design of internal combustion engines must cope with the increasingly stringent regulations on pollutant emissions. Accordingly, automotive engineers strive for designing engines with low fuel consumption and low emission of pollutants, which implies including electronic devices capable of monitoring the combustion performance and emissions in the exhaust gases.

In this connection, a proper operation of a fuel-injected engine requires that the fuel injectors and their controller allow for a timely, precise and reliable fuel injection. Indeed, it is well known that problems arise when the performance, or more particularly the timing, and the quantity of fuel delivered by the injectors diverge beyond acceptable limits. For example, injector performance deviation or variability will cause different torques to be generated between cylinders due to unequal fuel amounts being injected, or from the relative timing of such fuel injection. And this problem is particularly acute when injecting small fuel quantities, due to response delays at opening and closing.

In order to take into account the specificities of a solenoid actuated fuel injector, it has been proposed to associate to a given fuel injector a number of performance parameters thereof. These performance parameters are, e.g., encoded in a bar code applied to the injector, so that the performance parameters can be retrieved by a bar code scanner at the time of installation in the engine and transferred to the engine control unit (ECU). Such method for fuel injector parameters installation is for example described in U.S. Pat. No. 7,136,743.

Another method of fuel injector installation has been disclosed in WO2011/073147, which uses a segmented master performance curve. Each fuel injector to be installed in the engine is provided with specific fuel injector parameters in a machine-readable format, and these parameters are transferred to the engine ECU. Fitting information, preferably coefficients for a characteristic equation attributed to each respective segment of the master flow curve, are contained in these fuel injector-specific parameters.

The above method is beneficial in that it allows appropriately describing the flow performance per injector and provides finer control in the ballistic operating range. However, the ballistic range is a critical operating region and it has appeared that the above method may, under certain conditions, not discriminate cases where the injector does not open.

It is desirable to provide a method of controlling fuel injection in an internal combustion engine that avoids the above disadvantage.

SUMMARY OF THE INVENTION

In accordance with the present invention, a method of controlling fuel injection is provided, wherein the fuel injector is operated with a drive signal having a pulse width, which is calculated on the basis of a master performance function (fuel vs. pulse width) and of an injector-specific minimum delivery pulse.

As used herein, the term minimum delivery pulse (MDP) designates the smallest pulse width that will permit the delivery of fuel. The minimum delivery pulse can be learned or measured as the engine is running, and preferably periodically updated. The accuracy of the MDP will depend on the amount of effort spent to determine the MDP. In practice, a discrete measured pulse width (PW) value leading to a minute fuel amount can be used as MDP. Alternatively, the MDP value can be mathematically calculated (extrapolation or interpolation) from measured values.

Preferably, the pulse width is calculated on the basis of the master performance function and of the difference between master and injector-specific minimum delivery pulses. However, the method may be implemented so that the correction is only performed when the injector-specific minimum delivery pulse is greater than the master minimum delivery pulse.

For improved performance, the pulse width calculation may further be corrected to take into account a difference between master and injector-specific closing responses. The term closing response herein designates the time required for the injector pintle to reach the closed position, after the end of the drive signal.

The closing response may advantageously be calculated from the voltage across the coil of the injector's electromagnetic actuator, after the end of the drive signal. In particular, the actual closing time can be determined from a change of slope of the voltage trace.

The injector-specific minimum delivery pulse is also preferably determined from the voltage across the terminals of the fuel injector's electromagnetic actuator. In particular, the injector-specific minimum delivery pulse is preferably determined by comparing the duration (time extent) of a segment of the voltage second derivative to a predetermined (calibrated) threshold value, said segment duration corresponding to a measured duration of a segment of same algebraic sign (i.e. positive or negative) of the voltage second derivative after close of the injector.

This threshold value is preferably calibrated based on a correlation between MDP values determined by flow measurements and MDP values determined from the voltage across the fuel injector's electromagnetic actuator.

The present invention also concerns a system for controlling an injection time of an internal combustion engine.

According to a further aspect, the present invention concerns a method of detecting the opening of an electromagnetically actuated fuel injector. This method can be advantageously used in any method or system for controlling fuel injection.

BRIEF DESCRIPTION OF THE DRAWINGS

The present invention will now be described, by way of example, with reference to the accompanying drawings, in which.

DETAILED DESCRIPTION OF A PREFERRED EMBODIMENT

The present invention addresses the problem of part-to-part variability of fuel injectors, which is particularly acute in the ballistic region in the case of some modern designs of electromagnetically actuated (solenoid) fuel injectors. As it is known, a solenoid-actuated fuel injector generally comprises a valve group having a needle or pintle assembly that is axially moved in order to open and close one or more flow orifices through which fuel is sprayed in the engine. The fuel injector includes an electromagnetic actuator of the solenoid type that, through its armature, permits moving the pintle, typically against a return spring, to open the valve group and spray fuel in the engine combustion chamber.

The fuel injector is traditionally operated by a drive signal that is applied during a length known as "pulse width" (PW). Generally, to inject a fuel amount Q, a value of pulse width is read from a table, and the fuel injector is operated, for a given injector event, so that the drive signal is applied during a time corresponding to the pulse width, to influence a desired injection time and normally inject a given fuel amount. Hence, for any fuel injection to be performed a PW is generated to command a corresponding injector opening duration in order to deliver fuel.

As is it known in the art, the term "ballistic" is used to designate pintle movements for which the pintle essentially opens and closes, without remaining in (or even reaching) the fully open position. The problem of operating in the ballistic domain is that the pintle travel is particularly affected by opening and closing responses/delays (also known as switch-on or switch-off delays).

Figure 4:
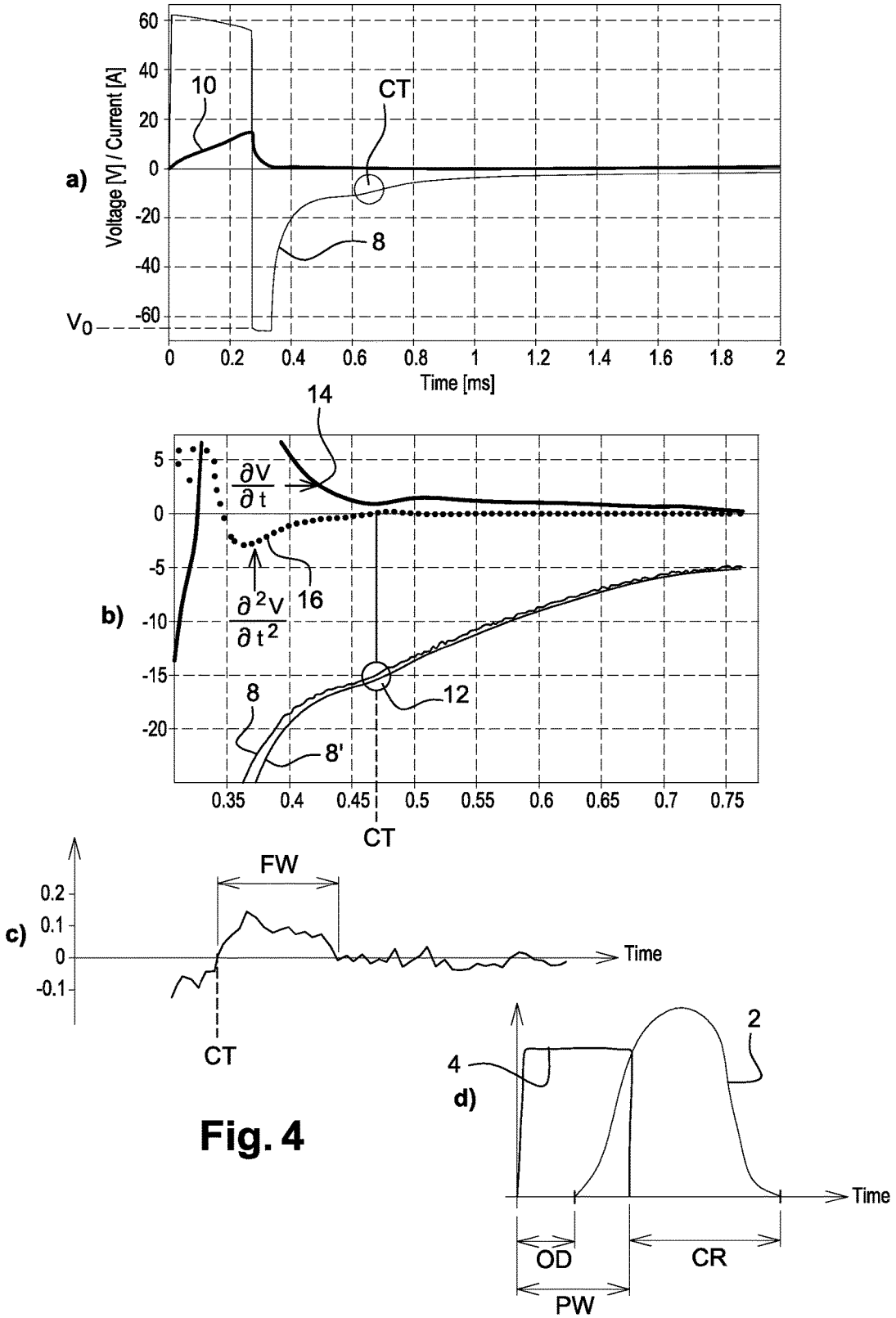
FIG. 4 are graphs of: a) Voltage and current across the injector solenoid vs. time; b) of the first and second derivatives of the voltage across the injector solenoid, also including the voltage trace and inflection point; c): of the secondary voltage derivative following the injector closing CT; d) of PW and valve lift for a ballistic injector stroke.

FIG. 4 *d*) shows a pintle lift curve 2 describing a bell shape, which is typical for the ballistic domain and illustrates the opening and closing responses. Reference sign 4 indicates the logic, drive signal that is applied to the fuel injector and causes opening thereof, by which fuel is sprayed in the engine combustion chamber.

The drive signal 4 is a pulse having a pulse width indicated PW, which is the time period during which the drive signal is applied. As can be seen, on application of the drive signal 4, it takes a certain time until the pintle starts moving; this time period is referred to as the "opening delay" or OD.

The time elapsed between the end of the drive signal 4 (end of PW) and the moment the pintle returns to its valve seat and stably closes the injector valve, is referred to as closing response, herein noted CR.

As it will be understood, the injected fuel quantity is proportional to the area below curve 2. A suitable formula for indicating the amount of fuel (Q) delivered by the fuel injector in response to the drive signal 10 may be:

$$Q=c\cdot(PW+a\cdot CR-b\cdot OD) \quad \text{(eq. 1)}$$

A number of methods have been developed to determine OD and CR, and strategies have been implemented to take these into account. Nevertheless, it has appeared that a shortcoming of conventional approaches is due to the existence of a threshold value of pulse width under which the injector needle does actually not open properly and no fuel is injected. The pulse width from which fuel starts flowing is known as Minimum Drive Pulse, or MDP. Due to part-to-part variability, this value can be considered specific for each injector in an engine. With respect to eq.1 above, it may be noted that the MDP is generally proportional to the OD, whereby the knowledge of the MDP alleviates the need for determining the OD.

Hence, while the traditional approaches relying on equation 1 above considered that, in the ballistic region, the injected fuel amount mainly depends on the closing response of the fuel injector, for some injectors the command pulse width may be below the injector minimum drive pulse, so that no fuel is injected.

The present method provides remedies to this situation. The present method is thus concerned with the control of fuel injection in an internal combustion engine having at least one cylinder with an associated electromagnetically actuated fuel injector for performing injector events, wherein for each injector event a drive signal having a pulse width PW is applied to the fuel injector to influence a desired injection/opening time.

The present method employs a master performance function fixing the relationship between desired fuel mass Q and pulse width PW. Hence, for injecting a fuel mass Q, a PW value is first determined on the basis of the master performance function, this PW value being further corrected on the basis of the injector-specific MDP.

A preferred embodiment of the present method of controlling fuel injection will now be presented below, together with a preferred method of determining the MDP for each injector applicable in said method.

Figure 1:
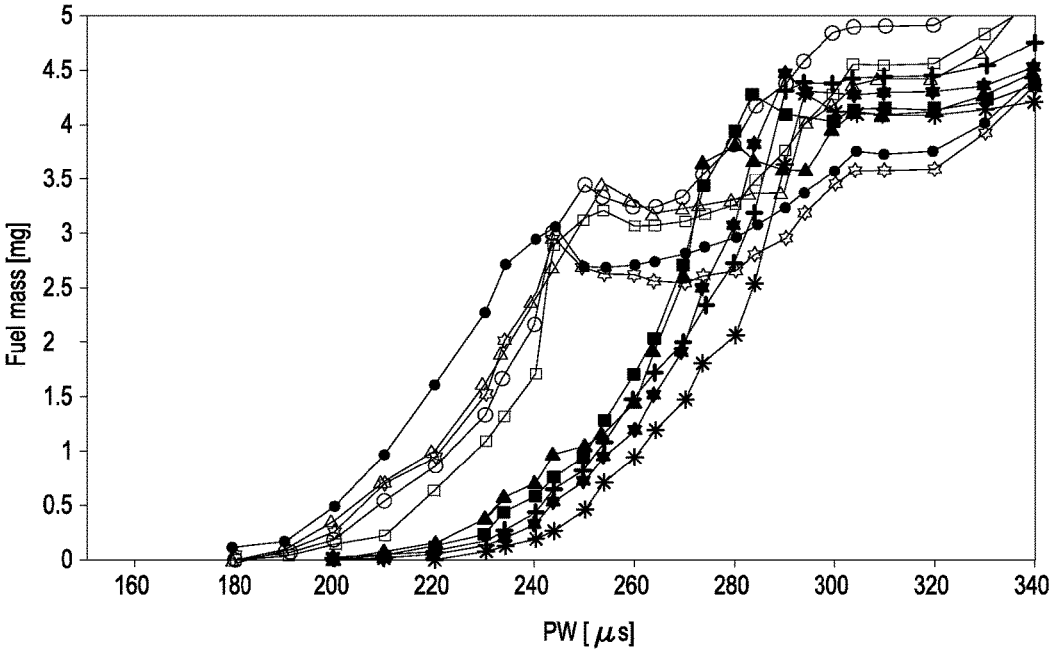
FIG. 1 is a graph (fuel mass Q vs. PW) illustrating the flow performance of a plurality of solenoid-actuated fuel injectors, in the ballistic region.

FIG. 1 is a graph (fuel mass Q vs. pulse width PW) illustrating the flow performance function of a plurality of solenoid-actuated injectors in the ballistic region. A non-negligible part-to-part variability can be observed. This graph also shows that at a given, small PW, say e.g. 210 μs, some injectors do not inject fuel while others deliver between 0.5 and 1 mg of fuel. For the injectors that do not inject, the minimum drive pulse MDP has thus not been reached.

As already explained above, it is known that switching times sensibly affect the delivered fuel quantity, the closing time being generally considered proportional to the delivered fuel mass in the ballistic domain.

The present Applicant had previously established that the injector pintle closing response can be determined based on the voltage feedback from the injector, i.e. from its solenoid actuator. The voltage may be measured across the injector coil terminals, after the termination of the drive signal. When the injector armature hits the seat and stops, there is a visible and measurable change of slope of the first derivative of the voltage, which can be used to detect the pintle closing. More specifically, at the injector closing there is an inflection in the slope of the injector coil voltage. Accordingly, one may take the derivative of the coil voltage and the local maximum (the signal is generally a negative quantity) of the derivative of the coil voltage happens to correlate with the closing time.

Referring to FIG. 4*a*), line 8 indicates the voltage at the injector's solenoid coil over time, while the current trace is indicated as line 10.

In the shown example of an actuating event in the ballistic domain, the actuation logic generates a step having a duration PW in order to charge the coil with the aim of opening the injector for to inject a predetermined amount.

Once PW has lapsed the objective is to close the actuator, and the control logic applies directly after PW a negative voltage $-V_0$ to the coil in order to collapse the current in the coil and cancel the magnetic field. After a certain time the current is null and the $-V_0$ voltage is suppressed. Then the coil voltage evolves from $-V_0$ to 0 (asymptotically).

Circle 12 indicates an inflection point in the voltage trace that has been observed to correspond to the closing time CT. This point can be determined from the first voltage derivative $$\frac{dV}{dt},$$

as a change of slope.

In connection with the present invention, it has now been found that the opening state of an injector can be related to the length (duration/time extent) of a positive portion or segment of the second voltage derivative $$\frac{\partial^2 V}{\partial t^2}$$

following the closing time CT.

In particular, a method has been devised according to which the actual opening of the injector can be detected by comparing this segment length of the second derivative for a given PW to a predetermined threshold. If this segment length exceeded the threshold, this means that the injector opened and actually injected fuel. This method can thus be used for determining the MDP of an injector.

In FIG. 4 *b*) the first and second voltage derivatives are indicated 14 and 16, respectively. As it will be understood by those skilled in the art, the inflection point of the voltage trace corresponding to the pintle closing may be mathematically defined as an ascending zero crossing of the voltage second derivative. Then the present criteria of interest for determining injector opening is the duration/length of the positive curve segment of the second derivative of the voltage following the injector closing, i.e. the length between CT (upward zero crossing at time CT) and the moment the positive curve again meets the x-axis, see FIG. 4*c*). This positive segment of the voltage secondary derivative following injector closing time CT is herein referred to as Flat Width or FW.

Without subscribing to any theory, it is believed that the length of the Flat Width is an image of the amplitude of the voltage trace inflection point and thus, in a way, reflects the magnitude of flux variation caused by the change of speed.

Figure 2:
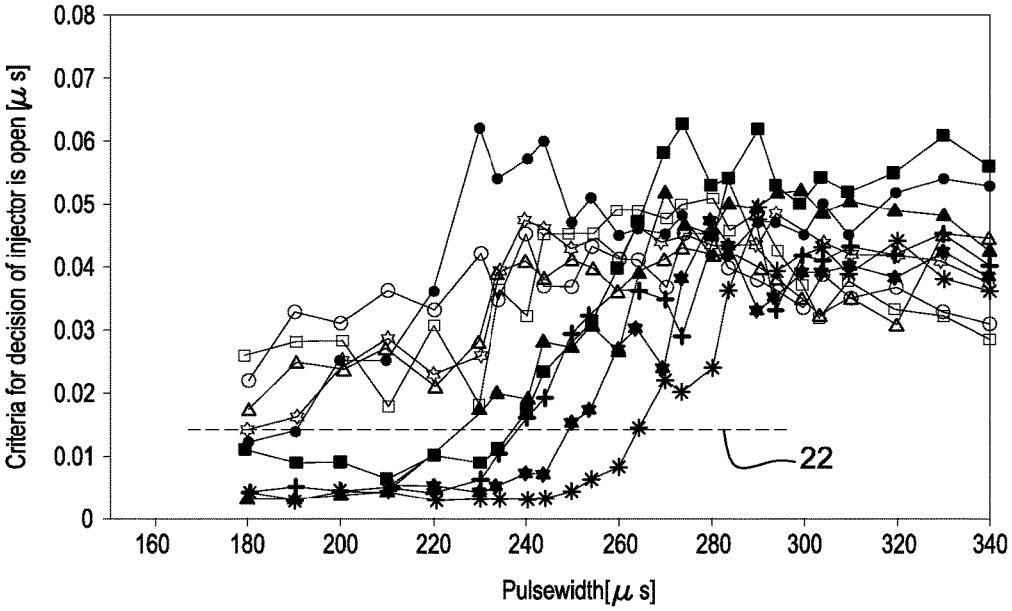
FIG. 2 is a graph of the "Flat Width" vs. PW for a plurality of solenoid-actuated fuel injectors.

FIG. 2 is a graph where the FW is plotted vs. PW. A horizontal dashed line represents the predetermined FW threshold, which is a calibrated value. For all points below the threshold line, it is considered that no fuel injection occurred, irrespective of the magnitude of pulse width. In accordance with the present process, the ideal MDP value is thus the PW value at which the FW is on the dashed line 22. In practice, the selected MDP value may be the PW corresponding to a point closest to (but above) the FW threshold, or an interpolated or calculated value to match or be very close to the FW threshold.

The FW threshold value can generally be calibrated based on the initial flow tests carried out to build the master performance function, since during the latter the relationship between PW and injected fuel mass is precisely determined (generally on a flow stand where the injected fuel mass can be measured) for a sample of fuel injectors. Preferably, for the purpose of the present method, the CT and FW are determined for each sample injector during calibration. One may thus determine the appropriate threshold value for the FW in order to identify injector opening from this set of data.

In a convenient approach, the FW threshold is selected based on the correlation coefficient between the real MDP (as determined from actual flow measurements) and the voltage determined MDP (based on FW), these points being acquired during the master build-up, as explained. A coefficient of correlation (least square linear regression) is determined for a variety of candidate FW thresholds (progressively increasing the FW threshold), and the selected FW threshold is that for which the correlation coefficient is the largest.

A preferred embodiment of the method of controlling fuel injection using the above MDP determination will now be explained.

As it is known, an engine control unit ECU generally operates to calculate a fuel amount as required to meet the driver's torque request in consideration of numerous operating parameters.

For injection purposes, the pulse width for actuating the fuel injector is determined from the master performance function defining the pulse width in function of the requested fuel quantity Q. Such master performance function may be stored in a memory as a map/table with discrete values of fuel quantity vs. pulse width. The master performance function may also be expressed by a mathematical expression, e.g. by one or more characteristic equations. It is further possible to combine mapped values and mathematical expression(s) to describe the Q-PW relationship on respective pulse width ranges.

The master performance function is used as a representative function for a group or population of injectors. It may thus generally be a calibrated/experimental curve/function and optionally a statistically representative curve.

A MDP for the master performance function is also determined, preferably by calibration and/or calculation. In addition, closing delays may be associated with each point of the master performance function.

When the engine is running, values of CT and MDP are learned from the voltage trace at various PW. A scheduler can be implemented in order to gather values and fill in a table. While the CT values are learned, FW values are also preferably determined for each PW in order to determine the MDP of each injector. In practice, the MDP value can be interpolated or the PW corresponding to the nearest measured FW value above the threshold may be used.

Once the MDP of each injector has been learned, a corrected pulse width may be calculated as:

$$PW_{cor}=PW_{master}+k_1(MDP_{inj}-MDP_{master}) \quad \text{(eq.2)}$$

where $PW_{master}$ is the PW determined from the master performance function for the desired fuel quantity Q; $MDP_{inj}$ and $MDP_{master}$ are the minimum delivery pulses of the specific injector and of the master, respectively, and $k_1$ is a possible adjustment coefficient.

In other words, the PW value is determined from a master function but corrected for the deviation in MDP.

Figure 3:
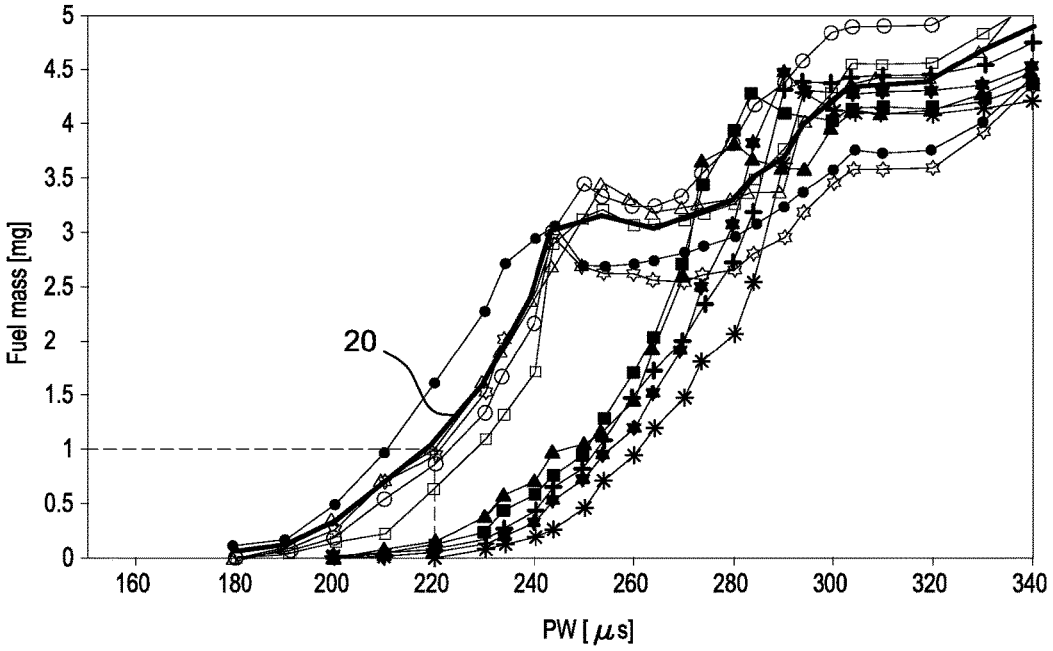
FIG. 3 is a graph of fuel mass vs. PW for a plurality of solenoid-actuated fuel injectors, also illustrating the master performance function.

Preferably, the master performance function has a relatively small MDP and is thus placed on the left of the graph of FIG. 3, where it is indicated 20. In such case, the correction mainly implies adding to the PW value determined from the master function a value compensating the retard in injector opening.

It may be noted that such a master performance function with small MDP can be obtained from a population of injectors, by taking flow data from a given proportion of injectors that have the smallest MDP. For example, for a sample of 100 injectors, one may build a master from the flow test values of the 50 or 25 injectors with earliest opening, by averaging the flow values.

To further increase the accuracy of the PW correction, the PW may be corrected to take into account the difference in closing time CT between the master performance function and the specific injector. Equation (2) may thus be amended as follows:

$$PW_{cor}=PW_{master}+k_1(MDP_{inj}-MDP_{master})-k_2(CT_{inj_pw}-CT_{master}) \quad \text{(eq. 3)}$$

to integrate the variation of closing response.

In eq. 3, $CR_{inj_pw}$ and $CR_{master}$ are the closing responses of the specific injector and of the master at the corresponding PW; and $k_2$ is a possible adjustment coefficient.

Hence, equation 3 gives a corrected PW value that can be used in the engine for commanding the length of the drive pulse.

Preferably, with a master positioned as in FIG. 3, the fuel control algorithm only applies the correction if $MDP_{inj}$ is greater than $MDP_{master}$.

The invention claimed is:

1. A method for controlling fuel injection in an internal combustion engine, said method comprising:

providing an electromagnetically actuated fuel injector used to inject fuel into an internal combustion engine;

detecting a voltage applied across terminals of the electromagnetic actuator of the fuel injector using an engine control unit in communication with the fuel injector, said engine control unit further configured to store in a memory a master performance function comprising data that defines a pulse width vs. a fuel quantity relationship; and applying a drive signal using a drive circuit to open and close the fuel injector, said drive circuit in communication with the engine control unit and the fuel injector, wherein the drive signal has a command pulse width that is calculated on the basis of the master performance function and on the basis of an injector-specific minimum delivery pulse, said injector-specific minimum delivery pulse corresponding to a minimum pulse width required for the fuel injector to open, wherein the injector-specific minimum delivery pulse is determined from the voltage across the terminals of the fuel injector's electromagnetic actuator, wherein the injector-specific minimum delivery pulse is determined by comparing a duration of a segment of a second derivative of the voltage to a predetermined threshold value, and wherein the duration of the segment of the second derivative of the voltage corresponds to the duration of the segment of the second derivative of the voltage of a same algebraic sign of the second derivative of the voltage after the closing of the fuel injector.

2. The method as claimed in claim 1, wherein the pulse width corresponding to the duration of the segment of the second derivative of the voltage having a duration closest or equal to the threshold value is defined as the injector-specific minimum delivery pulse.

3. The method as claimed in claim 1, wherein the threshold value is calibrated based on a correlation between the minimum delivery pulse values determined by a flow measurement and the minimum delivery pulse values determined from the voltage across the fuel injector's electromagnetic actuator.

4. The method as claimed in claim 1, wherein the closing of the fuel injector is determined based on a change of a slope of the voltage across the electromagnetic actuator coil, after an end of a drive pulse.

5. A system for controlling fuel injection in an internal combustion engine, said system comprising:

an electromagnetically actuated fuel injector used to inject fuel into an internal combustion engine;

an engine control unit in communication with the fuel injector, said engine control unit configured to store in a memory a master performance function comprising data that defines a pulse width vs. a fuel quantity relationship, said engine control unit further used to detect a voltage applied across terminals of the electromagnetic actuator of the fuel injector; and a drive circuit in communication with the engine control unit and the fuel injector, said drive circuit configured to output a drive signal used to open and close the fuel injector, wherein the drive signal has a command pulse width that is calculated on the basis of the master performance function and on the basis of an injector-specific minimum delivery pulse, said injector-specific minimum delivery pulse corresponding to the minimum pulse width required for the fuel injector to open, wherein the injector-specific minimum delivery pulse is determined from the voltage across the terminals of the fuel injector's electromagnetic actuator, wherein the injector-specific minimum delivery pulse is determined by comparing a duration of a segment of a second derivative of the voltage to a predetermined threshold value, said duration of a segment of the second derivative of the voltage corresponding the duration of the segment of the second derivative of the voltage of a same algebraic sign of the second derivative of the voltage after the closing of the fuel injector.

6. A method of detecting an opening of an electromagnetically actuated fuel injector, said method comprising:

providing an electromagnetically actuated fuel injector used to inject fuel into an engine;

providing a drive circuit configured to output a drive signal to open and close the fuel injector;

detecting, using an engine control unit in communication with the fuel injector and the drive circuit, applying a first voltage by the drive signal across terminals of the electromagnetic actuator to open the fuel injector;

applying a second voltage by the drive signal across the terminals of the electromagnetic actuator to close the fuel injector;

determining, with the engine control unit, the length of a curve segment of a same algebraic sign of the second derivative of the voltage; and concluding that the fuel injector has opened if the length of the curve segment exceeds a calibrated threshold value.

7. The method according to claim 6, wherein the closing of the fuel injector is determined based on a change of a slope of the voltage, after the end of the drive signal.

* * * * *